250-506.1

OR 4,278,892

T250/506.1

United Sta

Baatz et al.

[11] 4,278,892

[45] Jul. 14, 1981

[54] RADIOACTIVITY-SHIELDING TRANSPORT OR STORAGE RECEPTACLE FOR RADIOACTIVE WASTES

[75] Inventors: Heinrich Baatz, Essen; Dieter Rittscher, Heiligenhaus, both of Fed. Rep. of Germany

[73] Assignee: Steag Kernergie GmbH, Essen, Fed. Rep. of Germany

[21] Appl. No.: 966,951

[22] Filed: Dec. 6, 1978

[30] Foreign Application Priority Data

Dec. 9, 1977 [DE] Fed. Rep. of Germany ... 7737499[U]

[51] Int. Cl.[2] ..... G21F 5/00

[52] U.S. Cl. ..... 250/506; 250/515

[58] Field of Search ..... 250/506, 507, 515, 518; 176/67, 72, 87

[56] References Cited

U.S. PATENT DOCUMENTS

| | | | |
|---|---|---|---|
| 3,113,215 | 12/1963 | Allen | 250/506 |
| 3,659,107 | 4/1972 | Selle et al. | 250/506 |
| 4,016,096 | 4/1977 | Meyer | 250/506 |

*Primary Examiner*—Bruce C. Anderson
*Attorney, Agent, or Firm*—Karl F. Ross

[57] ABSTRACT

A unitarily cast receptacle for the storage of radioactive wastes consists of cast iron, especially spherolitic cast iron, or cast steel, and has upright walls defining a chamber in which the radioactive waste is stored above a base unitary with these walls. A cover is recessed in the receptacle and, according to the invention, is overlain by a safety cover which fits within an annular recess defined by a welding lip formed unitarily on the receptacle and defined at the upper end thereof by an upwardly open annular groove. The safety cover, which overlies the shielding cover which can be of the plug type, may have a counterlip which is likewise defined by an upwardly open annular groove.

9 Claims, 4 Drawing Figures

RADIOACTIVITY-SHIELDING TRANSPORT OR STORAGE RECEPTACLE FOR RADIOACTIVE WASTES

CROSS-REFERENCE TO RELATED APPLICATION

The present application is related to the commonly assigned copending application Ser. No. 940,856 filed Sep. 8, 1978 by two of the present joint inventors with another.

FIELD OF THE INVENTION

The present invention relates to a shielding transport or storage receptacle for radioactive wastes and, more particularly, to a receptacle of the type used to store radioactive substances such as irradiated nuclear reactor fuel elements with a minimum of release of radiation into the environment.

BACKGROUND OF THE INVENTION

In the above-identified copending application and elsewhere, a transport and storage vessel for radioactive wastes, especially for irradiated nuclear reactor fuel elements, has been made known which comprises a chamber defined by upright walls, i.e. a receptacle shell, a receptacle bottom and a shielding cover of the plug type which fits within the mouth of the receptacle.

The shell of the vessel and the bottom are formed unitarily of cast iron, especially spherolitic cast iron, or cast steel, and the shell or walls are provided with a shoulder or flange configuration which can engage an outwardly extending flange on the plug-type shielding cover.

The cast alloy or body can be provided with cells in which radiation-absorbing materials can be received, these cells being, for example, so orientated and constructed that they block straight-line paths from the interior of the receptacle outwardly.

The radiation-shielding effect, however, is primarily a result of the thickness of the vessel shell and bottom and the thickness or height of the cover which not only must take up the static stresses of transport and storage, but must be sufficient to effect the predominant shielding or adsorption of the radiation from the radioactive wastes whether this radiation is gamma radiation or neutrons.

In the earlier transport or storage vessels for the aforedescribed purpose, the shielding cover is held in place by threaded bolts. This enables, prior to the insertion of the cover, the introduction of the radioactive wastes into the interior of the vessel.

The sealing between the shielding cover and the vessel walls is effective for long periods, but only as long as any sealing agent remains effective or the sealing structure formed by the flange arrangement remains effective.

While such systems have proved to be effective, they nevertheless do not provide a closure which is not dependent upon the sealing means between the shielding cover and the receptacle nor do they permit control of the sealing, i.e. ascertainment of a failure of the shielding-cover seal.

OBJECT OF THE INVENTION

It is an object of the present invention to provide, in a shielding and transport vessel of the type described in the aforementioned copending application, which is hereby included in its entirety by reference, a hermetic closure of the vessel which is independent of the seal between the shielding cover and the vessel walls and which, in addition, affords sealing control or monitoring as may be required.

SUMMARY OF THE INVENTION

This object is achieved, in accordance with the present invention, in a receptacle or vessel for the shielding transport or shielding storage of radioactive wastes, especially irradiated fuel elements, which apart from the improvement described below can be of the type fully described in the above-identified application. According to the invention, the receptacle shell is formed along its upper face with an upstanding continuous annular welding lip which defines an annular opening into which an additional or safety cover can be fitted. The safety cover can, in accordance with this invention, be formed with an annular counterlip which lies adjacent the first-mentioned lip and defines an annular welding crevice or junction in which a deposit weld is formed along the upper face of the container.

The bead of weldment between these lips can be formed readily by any cast iron or cast steel deposit welding technique because the lips themselves are separated from the mass of the container shell and the mass of the safety cover, respectively, by annular upwardly open grooves. Heat conduction away from the welding site is thus minimized.

The safety cover thus overlies the shielding cover and is hermetically sealed to the container wall by the weld seam.

In a construction in which the container is provided with a conduit opening from the upper end face into the upper part of the interior of the vessel to allow a fluid to be introduced into the vessel as described in the aforementioned application, the conduit being cast in place or being formed by a space in the cast material, the invention provides that the mouth of this conduit also be closed by the safety cover, i.e. that the safety cover extend over this mouth and that the bead of weldment be deposited outwardly thereof.

The system of the present invention has been found to be highly effective in that it affords a seal for the vessel which is not dependent upon the seal between the shielded cover and the body of the vessel.

The resulting shielding transport and/or shielding storage receptacle for radioactive waste thus fulfills all of the requirements for such a container and fulfilled by conventional containers with the additional advantage that a greater degree of safety is afforded.

While the safety cover is welded onto the vessel wall to provide the hermetic seal, the contents of the vessel remain accessible since the bead of weldment can simply be burned away and the safety cover removed, thereby affording access to the shielding cover.

It has been found to be advantageous to provide the safety cover with a bore to which a suction duct can be connected to ascertain whether the seal between the vessel and the shielding cover remains effective. In the event of a failure of the latter seal, the high pressure gas usually provided within the vessel, e.g. helium, can penetrate into the space beneath the safety cover and can be drawn by the suction duct from this space.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
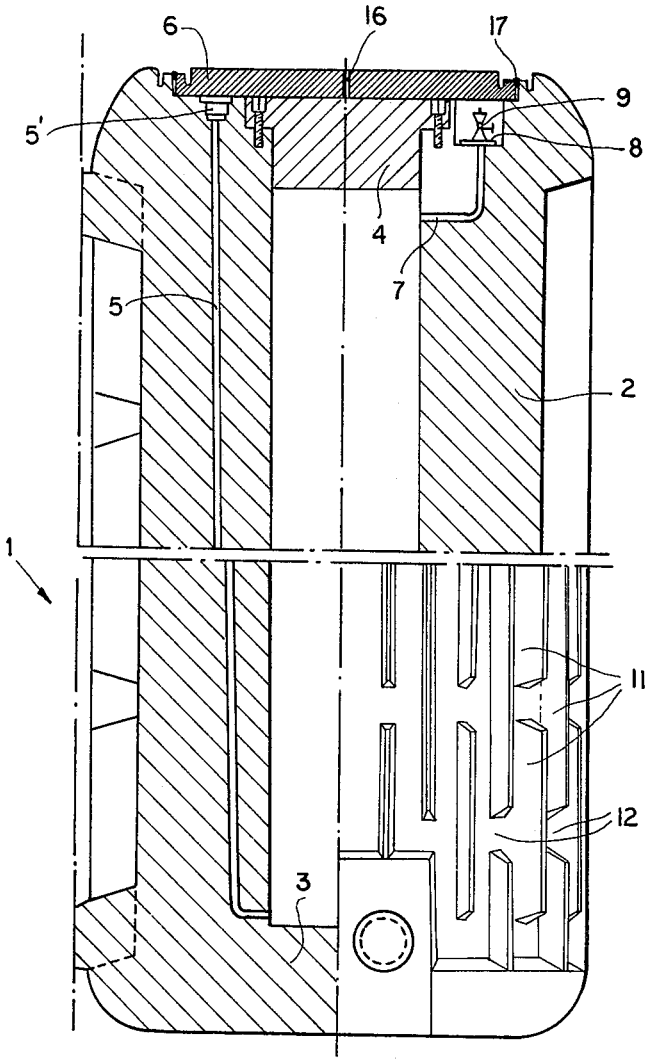
FIG. 1 is a vertical section, partly shown in elevation, through a receptacle embodying the present invention.
Figure 3:
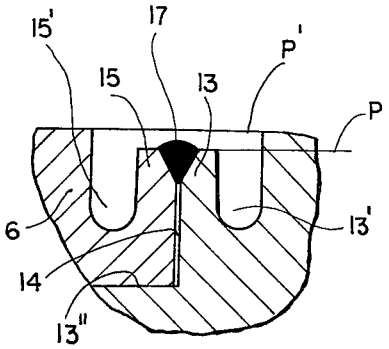
FIG. 3 is a detail view of the sealing region for the safety cover of the present invention in cross section.

The drawing shows a radiation-shielding transport or storage receptacle 1 for radioactive wastes, especially for irradiated nuclear reactor fuel elements, which comprises a receptacle shell 2, a bottom 3 and a shielding cover 4. The receptacle shell 2 and the bottom 3 are formed unitarily from cast iron, especially spherolitic cast iron, of cast steel or the like. The shielding cover 4 is provided with a flange which is bolted to a shoulder inset in the mouth of the receptacle.

The shell 2 comprises at least one cast-in-place conduit or passage 5 which communicates with the interior of the vessel close to the bottom thereof so that a fluid can be introduced or removed from a fitting 5' at the upper end of the vessel. In the embodiment illustrated and in the best-mode embodiment of the invention, a further passage or conduit 7 is cast in place in the thick wall 2 of the vessel. This conduit 7 opens into the upper end of the interior of the vessel and terminates in a chamber 8 in which a valve 9 is received or into which a valve 9 can be introduced. The conduits 7 and 5 and their valve or valves can be used for circulating a fluid through the interior of the vessel. The valve 9 can also be a pressure-relief valve to which a hose or length of tubing can be connected.

Figure 2:
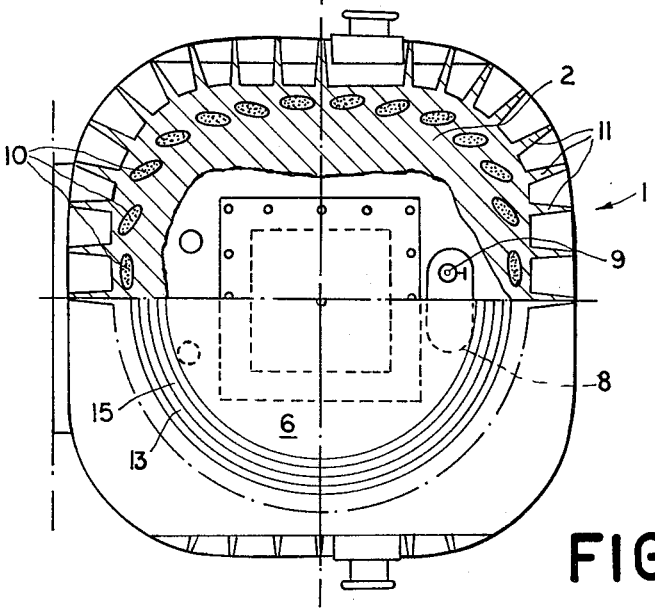
FIG. 2 is a cross section in its upper half and a plan view in its lower half of the receptacle of FIG. 1.

As has especially been shown in FIG. 2, the passages 5 and 7 are located in the inner half of the thickness of the wall 2. This permits further passages 10 to be formed in the outer half of the thickness of the wall, the passages 10 extending the full length of the receptacle and along the bottom so that they can be filled with a material of higher radiation-adsorbing cross section, i.e. a so-called moderating material. This has been found to be especially advantageous when the container receives nuclear wastes having a high neutron activity. The passages 10, like the passages 5 and 7, can be closed at the top of the vessel by a safety cover 6 which overlies the shielding cover 4 and is applied after the shielding cover 4 has been bolted in place. The shielding cover 4 has the configuration of a plug to provide the necessary thickness for limiting the passage of radiation out of the interior of the vessel.

As is also apparent from the drawing, the exterior of the shell 2 of the vessel is provided with cooling ribs 11 which can run parallel to the generatrix of the vessel wall. The individual cooling ribs 11 are cast unitarily with the wall and can be provided with gaps 12 along their lengths for expansion and contraction. The gaps 12, therefore, subdivide the cooling ribs 11 into elongated sections.

According to the present invention, at the upper edge of the vessel wall 2, a continuous upstanding annular welding lip 13 is formed by an upwardly open groove 13' while the safety cover 6 is provided with a corresponding upstanding welding lip 15 along its outer periphery by an upwardly open groove 15'. The lips 13 and 15 are parallel to one another and terminate in a common plane P below the plane P' of the upper surface of the receptacle.

The lips 13 and 14 define a welding crevice in which a bead of weldment 17 can be deposited to form the hermetic seal. The lip 13 with the shoulder 13'' of the vessel wall 2 provides an annular space 14 in which the cover 6 is received.

In the embodiment shown in the drawing, moreover, the weld seam 17 is located outwardly of the fitting 5' and the chamber 8 so that it hermetically seals the passages 5 and 7 as well as the passages 10 if the latter are similarly disposed within the perimeter of this weld seam.

Prior to insertion of the cover 4 and the emplacement of the cover 6, water filling the interior of the vessel can be evacuated by the conduit 5.

The conduit 5 can, however, be used for other purposes as well. For instance, it can be employed for introducing liquid radioactive wastes into the vessel or for supplying or circulating special coolants to the vessel or for passing a coolant through the vessel to abstract heat from the radioactive wastes contained therein. Any other passages or conduits required for this purpose can also be cast in place within the body of the vessel and closed similarly.

Figure 4:
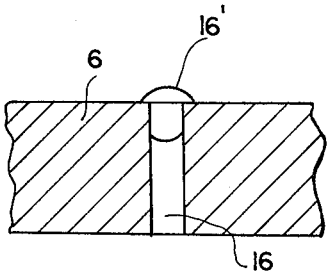
FIG. 4 is a detailed cross-sectional view showing another portion of the safety cover.

As has been shown in FIGS. 1 and 4, the safety cover 6 can be provided with a bore 16 into which can be force-fitted a plug 16' or which can be welded shut. This bore can receive, once the plug 16' or the weldment is removed, a suction line to enable a gas detector to analyze withdrawn gases. When the interior of the vessel is pressurized with helium, the escape of helium into the space below the cover 6 and detected by withdrawal from the passage 16 indicates a failure of the seal between the shielding cover 4 and the remainder of the vessel. As the seal between the shielding cover 4 and the body of the vessel is monitored, any leakage can be detected so that replacement of the shielding cover 4 can be effected or repair of the seal ensured. To this end, the bead 17 of weldment can be simply burned off and the cover 6 removed to effect repair. With replacement of the cover 6, the hermetic seal by the formation of another deposit weld can be re-instituted.

We claim:

1. A shielding transport and storage vessel for radioactive wastes, comprising:

a receptacle body cast unitarily with an upstanding wall and a bottom defining the interior of the receptacle;

a shielding cover received in said receptacle and capable of resisting radiation transmission from the interior thereof, said body being formed with a shoulder and said shielding cover with a flange resting upon and connected to said shoulder; and a safety cover overlying said shielding cover and hermetically sealed to said wall, said wall having an upper end formed with an annular continuous upstanding welding lip and said safety cover formed with an upstanding welding lip adjacent the welding lip of said body, the hermetic seal between said safety cover and said body being effected by a bead of weldment bridging said lips, at least one passage being cast into said body and opening at the upper end thereof, said safety cover extending beyond and overlying the opening of said passage, thereby sealing same.

2. The receptacle defined in claim 1 wherein said body is formed from a cast metal.

3. The receptacle defined in claim 2 wherein said cast metal is spherolitic cast iron or cast steel.

4. The receptacle defined in claim 3 wherein said body is formed unitarily with a plurality of elongated cooling ribs along its exterior, said ribs extending parallel to generatrices of said wall.

5. The receptacle defined in claim 4 wherein said cooling ribs are subdivided into sections by expansion and contraction gaps.

6. The receptacle defined in claim 5 wherein said passage is formed with a valve and opens at said upper end of said body into a chamber overlain by said safety cover.

7. The receptacle defined in claim 1 wherein said each of said welding lips is defined by an upwardly open annular groove in said body and said safety cover respectively, said lips terminating in a plane below a plane of the upper end face of the receptacle.

8. The receptacle defined in claim 7 wherein said body is formed with a further shoulder outwardly of the first-mentioned shoulder and defining with the welding lip of said body an annular recess receiving said safety cover, said safety cover resting on said further shoulder.

9. The receptacle defined in claim 8 wherein said body is formed with a plurality of passages receiving a material of higher neutron-absorption cross-section than the material of said body.

* * * * *

UNITED STATES PATENT AND TRADEMARK OFFICE

CERTIFICATE OF CORRECTION

PATENT NO. : 4,278,892

DATED : 14 July 1981

INVENTOR(S) : Heinrich Baatz et al

It is certified that error appears in the above-identified patent and that said Letters Patent are hereby corrected as shown below:

In the heading, left column, item [75], correct the first inventor's name to read:

-- HENNING BAATZ --

Signed and Sealed this

*Twenty-ninth* Day of *December 1981*

[SEAL]

*Attest:*

GERALD J. MOSSINGHOFF

*Attesting Officer*

*Commissioner of Patents and Trademarks*